US009010677B2

(12) United States Patent
Young et al.

(10) Patent No.: US 9,010,677 B2
(45) Date of Patent: Apr. 21, 2015

(54) REPLACEABLE COVER FOR BARS IN A PRINTING SYSTEM

(75) Inventors: Timothy J. Young, Williamson, NY (US); Christopher S. Garcia, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 612 days.

(21) Appl. No.: 13/433,479

(22) Filed: Mar. 29, 2012

(65) Prior Publication Data

US 2013/0256449 A1 Oct. 3, 2013

(51) Int. Cl.
*B65H 23/32* (2006.01)

(52) U.S. Cl.
CPC ..... *B65H 23/32* (2013.01); *B65H 2301/332* (2013.01); *B65H 2301/312* (2013.01); *B65H 2301/333* (2013.01); *B65H 2601/324* (2013.01)

(58) Field of Classification Search
CPC ..... B65H 23/32; B65H 2301/312; B65H 2301/332; B65H 2301/333; B65H 2601/324
USPC ..... 242/615.21, 615.4
See application file for complete search history.

*Primary Examiner* — William E Dondero
(74) *Attorney, Agent, or Firm* — Nancy R. Simon; Amit Singhal

(57) ABSTRACT

A paper transport system for transporting a web in a printing system includes a stationary bar positioned such that the web slides over a portion of an exterior surface of the bar, a rotatable source roller for supplying unused cover material, and a rotatable take-up roller for receiving used cover material. Cover material extends between the source roller and the take-up roller and is disposed over the portion of the exterior surface of the bar that the web slides over. A locking mechanism can be used to maintain tension in the cover material.

13 Claims, 5 Drawing Sheets

REPLACEABLE COVER FOR BARS IN A PRINTING SYSTEM

TECHNICAL FIELD

The present invention generally relates to printing systems and more particularly to bars suitable for use in printing systems and methods for transporting the web. Still more particularly, the present invention relates to a replaceable cover material for bars in a printing system.

BACKGROUND

Continuous web printing allows economical, high-speed, high-volume print reproduction. In this type of printing, a continuous web, such as print media (e.g., paper) or a support mechanism in which the print media is disposed over, is fed past one or more printing subsystems or modules that form images by applying one or more colorants onto the surface of the print media. Various components within a printing system are used to create tension in the web so that the web does not shift in the in-track (the direction of movement) and cross-track directions as the web moves through the printing system. The tension is also used to inhibit fluttering (up or down motion) as the web travels through the printing system.

Some of the components used to produce and adjust the tension in the web or to transport the web through a printing system are stationary bars placed at different locations within the printing system. Stationary bars include turnbars and S-wraps. Turnbars are frequently used to change the direction of the web or as a pair to flip over the print media, while S-wraps are used to produce tension in the web. The stationary bars have curved surfaces that the web slides over during transport. As the web is pulled over these surfaces, the friction of the web across these surfaces produces tension in the web.

Some bars are "static" in which the web runs directly on the bar. For turnbar applications, a cover material with a low coefficient of friction is typically applied over the contact surface to reduce drag from the web. Generally, this low coefficient of friction cover material is adhered with adhesive directly onto the exterior surface of the bars. The material must be applied smoothly, with no wrinkles or bubbles that could adversely affect web tracking.

Typically, the web travels through the printing system at a high rate of speed. By way of example only, the web can travel six hundred to one thousand feet per minute. Over time, the combination of the high speed and the friction of the web produce heat and wear on the low-friction cover material on the exterior surfaces of the bars. The low-friction cover material can wear to the point of causing web handling problems. Since the cover material is adhered directly to the bars, it can be difficult and time consuming to replace the material. When the wear reaches an unacceptable level, the bars are removed from the printing system and either the low-friction cover material re-conditioned or the bar is replaced entirely. Replacing the bars can take several hours, during which time the printing system is shut down. Moreover, the alignment of the web in the printing system must be re-calibrated once the bars have been replaced. These actions increase the cost of a print job and reduce the throughput of the printing system.

SUMMARY

According to one aspect, a paper transport system for transporting a web in a printing system includes a bar positioned such that the web slides over a portion of an exterior surface of the bar, a rotatable source roller supplying unused cover material, and a rotatable take-up roller receiving used cover material. Cover material extends between the source roller and the take-up roller and is disposed over the portion of the exterior surface of the bar that the web slides over.

According to another aspect, a turnover module in a printing system includes at least one turnbar, and for each turnbar, a rotatable source roller supplies unused cover material and a rotatable take-up roller receives used cover material. Cover material extends between the source roller and the take-up roller and is disposed over the portion of an exterior surface of the turnbar that the web slides over.

According to another aspect, a locking mechanism can be used to maintain tension in the cover material. By way of example only, the locking mechanism can be at least one pair of pinch rollers, where the cover material is disposed between the pinch rollers in each pair of pinch rollers.

According to another aspect, a motor can be connected to the source roller and the take-up roller to cause the source and take-up rollers to rotate continuously. For example, the source and take-up rollers can continuously rotate during a print job or for a given amount of time.

According to another aspect, a method for replacing a cover material disposed over a portion of an exterior surface of a bar in a printing system includes determining whether the cover material disposed over the portion of the exterior surface of a bar needs replacement, and if the cover material needs replacement, rotating a source roller supplying unused cover material and rotating a take-up roller receiving used cover material, where cover material extends between the source roller and the take-up roller and is disposed over the portion of the exterior surface of the turnbar.

According to another aspect, the method can include engaging a locking mechanism to maintain tension in the cover material.

According to another aspect, the method can include continuously rotating the source and take-up rollers. For example, the source and take-up rollers can continuously rotate during a print job or for a given amount of time.

BRIEF DESCRIPTION OF THE DRAWINGS

Embodiments of the invention are better understood with reference to the following drawings. The elements of the drawings are not necessarily to scale relative to each other. Like numbers indicate like parts throughout the views.

DETAILED DESCRIPTION

Figure 1:
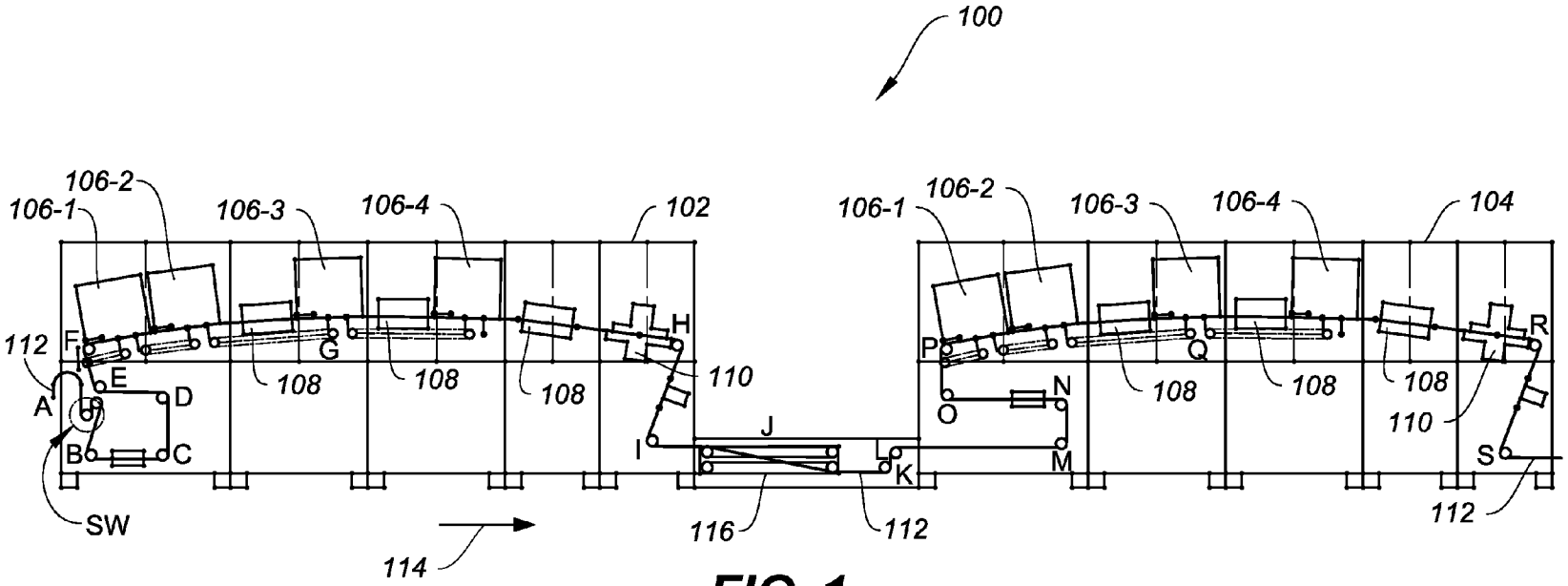
FIG. 1 is a schematic side view of one example of a continuous web printing system in an embodiment in accordance with the present invention.

Throughout the specification and claims, the following terms take the meanings explicitly associated herein, unless the context clearly dictates otherwise. The meaning of "a," "an," and "the" includes plural reference, the meaning of "in" includes "in" and "on." Additionally, directional terms such as "on", "over", "top", "bottom", "left", "right" are used with reference to the orientation of the Figure(s) being described. Because components of embodiments of the present invention can be positioned in a number of different orientations, the directional terminology is used for purposes of illustration only and is in no way limiting.

The present description will be directed in particular to elements forming part of, or cooperating more directly with, an apparatus in accordance with the present invention. It is to be understood that elements not specifically shown, labeled, or described can take various forms well known to those skilled in the art. In the following description and drawings, identical reference numerals have been used, where possible, to designate identical elements. It is to be understood that elements and components can be referred to in singular or plural form, as appropriate, without limiting the scope of the invention.

The example embodiments of the present invention are illustrated schematically and not to scale for the sake of clarity. One of ordinary skill in the art will be able to readily determine the specific size and interconnections of the elements of the example embodiments of the present invention.

As described herein, the example embodiments of the present invention apply to bars that support a moving web as the web is transported through a printing system. The web can be the print media or a support mechanism that is routed through the printing system. Inkjet printing is commonly used for printing on paper, where paper is the print media. However, there are numerous other materials in which inkjet is appropriate. For example, vinyl sheets, plastic sheets, textiles, paperboard, and corrugated cardboard can comprise the print media. Additionally, although the term inkjet is often used to describe the printing process, the term jetting is also appropriate wherever ink or other liquids is applied in a consistent, metered fashion, particularly if the desired result is a thin layer or coating.

However, many other applications are emerging which use inkjet printheads to emit liquids (other than inks) that need to be finely metered and deposited with high spatial precision. Such liquids include inks, both water based and solvent based, that include one or more dyes or pigments. These liquids also include various substrate coatings and treatments, various medicinal materials, and functional materials useful for forming, for example, various circuitry components or structural components. As such, as described herein, the terms "liquid" and "ink" refer to any material that is ejected by the printhead or printhead components described below.

Inkjet printing is a non-contact application of an ink to a print media. Typically, one of two types of ink jetting mechanisms are used and are categorized by technology as either drop on demand ink jet (DOD) or continuous ink jet (CIJ). The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CIJ) printing, uses a pressurized ink source to produce a continuous liquid jet stream of ink by forcing ink, under pressure, through a nozzle. The stream of ink is perturbed using a drop forming mechanism such that the liquid jet breaks up into drops of ink in a predictable manner. One continuous printing technology uses thermal stimulation of the liquid jet with a heater to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection.

Additionally, there are typically two types of web used with inkjet printing systems. The first type is commonly referred to as a continuous web while the second type is commonly referred to as a cut sheet(s). The continuous web refers to a continuous strip of print media, generally originating from a source roll. The continuous web of print media is moved relative to the inkjet printing system components via a web transport system, which typically include drive rollers, web guide rollers, and web tension sensors. Cut sheets refer to individual sheets of print media that are moved relative to the inkjet printing system components via a support mechanism (e.g., rollers and drive wheels or via a conveyor belt system) that is routed through the inkjet printing system.

The invention described herein is applicable to both types of printing technologies. As such, the term web, as used herein, is intended to be generic and not as specific to either type of web or the way in which the web is moved through the printing system.

The terms "upstream" and "downstream" are terms of art referring to relative positions along the transport path of the print media; points on the transport path move from upstream to downstream. In FIG. 1 the print media moves from left to right as indicated by feed direction arrow 114. Where they are used, terms such as "first", "second", and so on, do not necessarily denote any ordinal or priority relation, but are simply used to more clearly distinguish one element from another.

Referring now to the schematic side view of FIG. 1, there is shown one example of a continuous web printing system in an embodiment in accordance with the invention. Printing system 100 includes a first printing module 102 and a second printing module 104, each of which includes lineheads 106, dryers 108, and a quality control sensor 110. Each linehead 106 typically includes multiple printheads (not shown) that apply ink or another liquid to the surface of the continuous web of print media 112 that is adjacent to the printheads. For descriptive purposes only, the lineheads 106 are labeled a first linehead 106-1, a second linehead 106-2, a third linehead 106-3, and a fourth linehead 106-4. In the illustrated embodiment, each linehead 106-1, 106-2, 106-3, 106-4 applies a different colored ink to the surface of the print media 112 that is adjacent to the lineheads. By way of example only, linehead 106-1 applies cyan colored ink, linehead 106-2 magenta colored ink, linehead 106-3 yellow colored ink, and linehead 106-4 black colored ink.

The first printing module 102 and the second printing module 104 also include a web tension system that serves to physically move the print media 112 through the printing system 100 in the feed direction 114 (left to right as shown in the figure). The print media 112 enters the first printing module 102 from a source roll (not shown) and the linehead(s) 106 of the first module applies ink to one side of the print media 112. As the print media 112 feeds into the second printing module 104, a turnover module 116 is adapted to invert or turn over the print media 112 so that the linehead(s) 106 of the second printing module 104 can apply ink to the other side of the print media 112. The print media 112 then exits the second printing module 104 and is collected by a print media receiving unit (not shown).

First printing module 102 has a support structure that includes a cross-track positioning mechanism (A) for positioning the continuously moving web of print media in the cross-track direction, that is, orthogonal to the direction of travel and in the plane of travel. In one embodiment, cross-track positioning mechanism (A) is an edge guide for registering an edge of the moving media. An S-wrap device (SW), affixed to the support structure of first module 102, includes structure that sets the tension of the print media.

Downstream from the first printing module 102 along the path of the print media 112, the second printing module 104 also has a support structure similar to the support structure for first printing module 102. Affixed to the support structure of either or both the first or second module is a kinematic connection mechanism that maintains the kinematic dynamics of the print media 112 in traveling from the first printing module 102 into the second printing module 104. Also affixed to the support structure of either the first or second module are one or more angular constraint structures for setting an angular trajectory of the print media 112.

Table 1 that follows identifies the lettered components used for print media transport as shown in FIG. 1. An edge guide in which the print media 112 is pushed laterally so that an edge of the media contacts a stop is provided at (A). The slack print media entering the edge guide allows the print media 112 to be shifted laterally without interference and without being over-constrained. The S-wrap device (SW) provides stationary curved surfaces over which the continuous print media 112 slides during transport. As the print media 112 is pulled over these surfaces, the friction of the print media 112 across these surfaces produces tension in the print media. In one embodiment, the S-wrap device (SW) is adapted to adjust the positional relationship between surfaces, to control the angle of wrap and to allow adjustments in the tension of the print media.

TABLE 1

Roller Listing for FIG. 1

| Media Handling Component | Type of Component |
|---|---|
| A | Lateral Constraint (edge guide) |
| SW | S-wrap device |
| B | In-Feed Drive Roller |
| C | Castered and Gimbaled Roller |
| D | Gimbaled Load Cell |
| E | Servo-Castered and Gimbaled Roller |
| F | Fixed Roller (tach) |
| G | Rainbow Rollers (Qty = 17, 8 linehead, 6 dryer, 3 QC) |
| H | Servo-Castered and Gimbaled Roller |
| I | Gimbaled Roller |
| J | First Turnover Mechanism Drive |
| K | Second Turnover Mechanism Drive |
| L | Castered and Gimbaled Roller |
| M | Gimbaled Roller |
| N | Gimbaled Load Cell |
| O | Servo-Castered and Gimbaled Roller |
| P | Fixed Roller (tach) |
| Q | Rainbow Rollers (Qty = 17, 8 linehead, 6 dryer, 3 QC) |
| R | Servo-Castered and Gimbaled Roller |
| S | Out-Feed Drive Roller |

The first angular constraint is provided by in-feed drive roller B. This is a fixed roller that cooperates with a drive roller in the turnover module 116 and with an out-feed drive roller N in second printing module 104 in order to move the print media 112 through the printing system 100 with suitable tension in the feed direction 114. The tension provided by the preceding S-wrap device (SW) serves to hold the print media 112 against the in-feed drive roll. Angular constraints at subsequent locations downstream along the print media 112 are provided by rollers that are gimbaled so as not to impose an angular constraint on the next downstream media span.

Although FIG. 1 depicts each printing module with four lineheads 106, three dryers 108, and one quality control sensor 110, embodiments in accordance with the invention are not limited to this construction. A printing system can include any number of lineheads, any number of dryers, and any number of quality control sensors. The printing system can also include a number of other components, including, but not limited to, web cleaners and web tension sensors.

And although the printing system shown in FIG. 1 has the turnover module 116 disposed between the first and second printing modules 102, 104, other printing systems can include the turnover module within one of the printing modules.

The invention will now be described with reference to a turnbar in a turnover module. Embodiments of the invention, however, are not limited to this type of bar in a paper transport system. Those skilled in the art will recognize the invention can be used with other components in a paper transport system. The present invention can be used with any stationary object, commonly referred to as "brush bars", in the transport path of a printing system.

Figure 2:
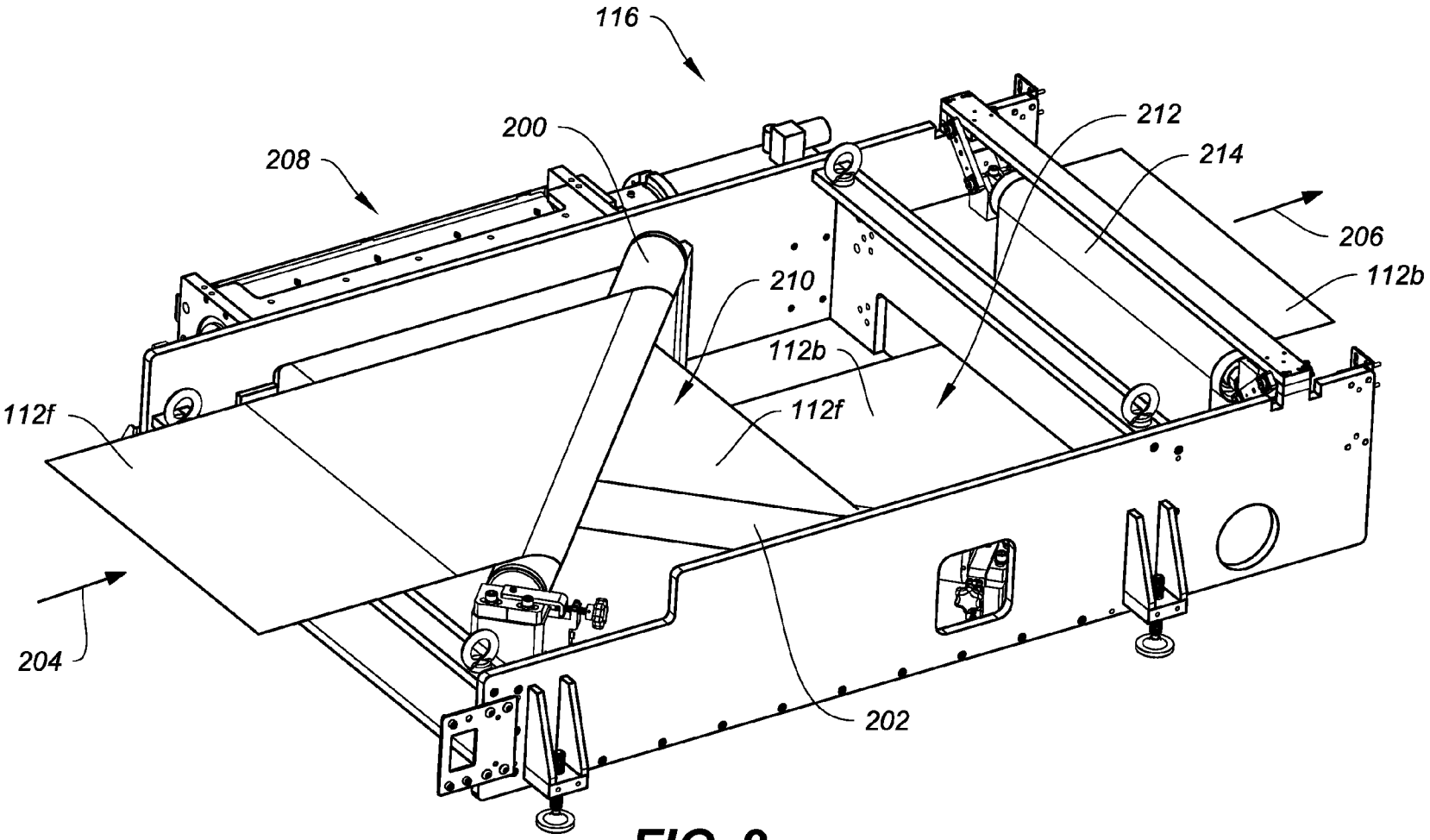
FIG. 2 illustrates a top perspective view of one example of a turnover module suitable for use in printing system 100 in an embodiment in accordance with the invention.

FIG. 2 illustrates a top perspective view of one example of a turnover module suitable for use in printing system 100 in an embodiment in accordance with the invention. Turnover module 116 includes stationary turnbars 200, 202 positioned at different angles with respect to the input path 204 and the output path 206. Other embodiments in accordance with the invention can include one or more turnbars in a turnover module. For example, one turnbar can be included in a turnover module that redirects the print media ninety degrees. The web is fed directly from the exit of turnbar 200 into a second print module oriented perpendicular to the first print module.

Figure 3:
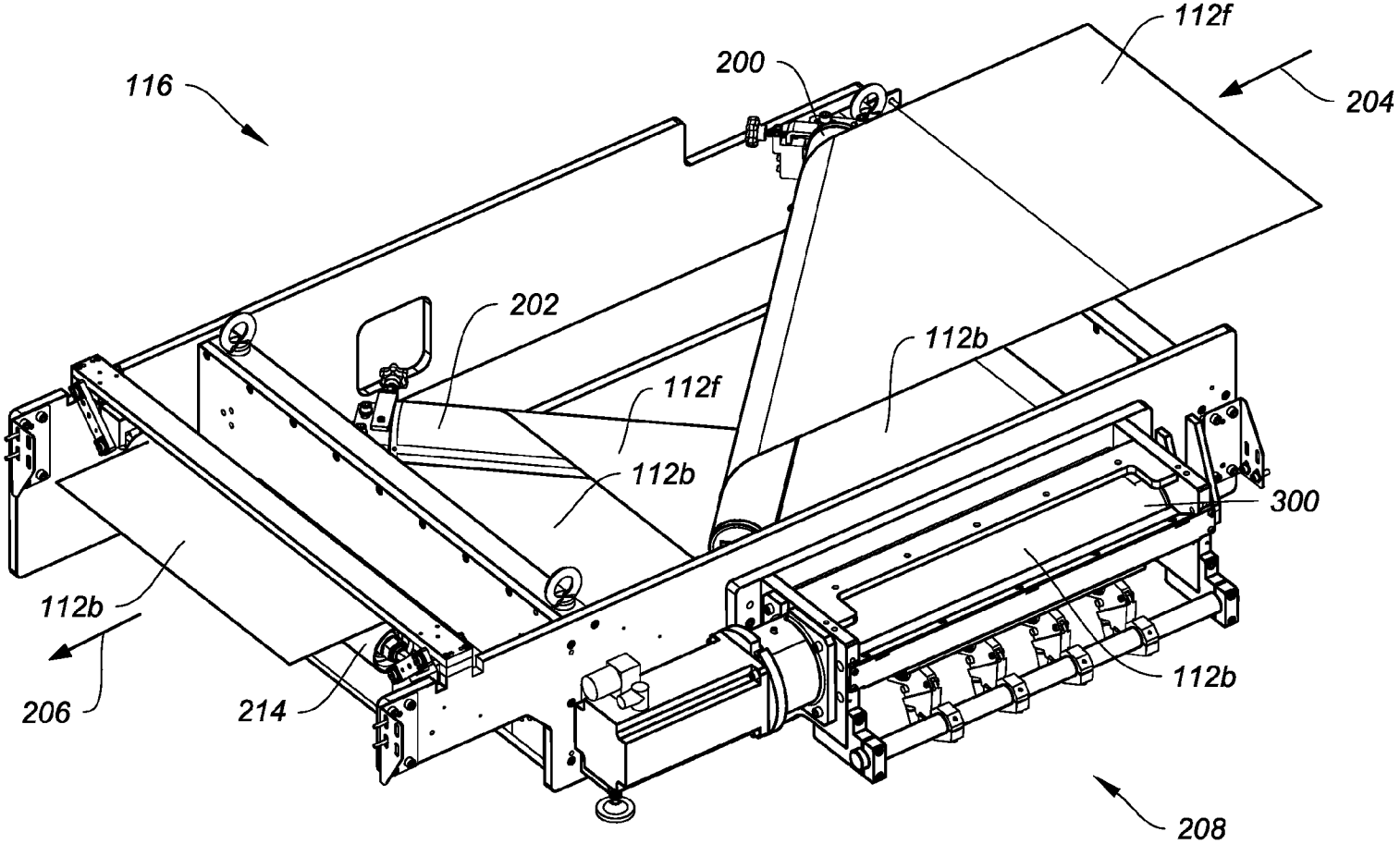
FIG. 3 is another top perspective view of the turnover module 116 shown in FIG. 2.
Figure 4:
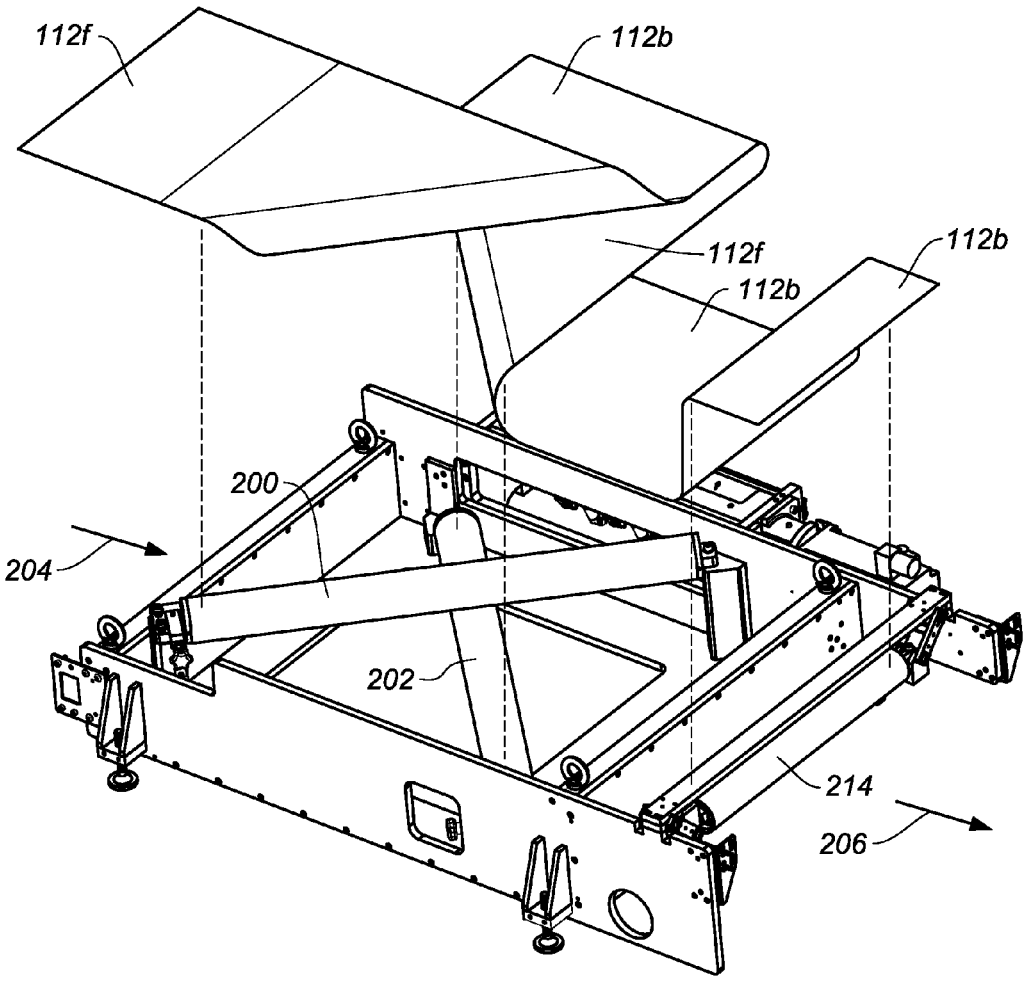
FIG. 4 illustrates the path of the print media through turnover module 116 shown in FIGS. 2 and 3 in an embodiment in accordance with the invention.

The print media 112 enters along the input path 204 with ink or another liquid jetted onto a front side of the print media 112. In FIGS. 2-4, the front side of the print media is identified as 112*f* and the back side of the print media as 112*b*.

The print media 112 then wraps around stationary turnbar 200 and passes to unit 208, where the print media wraps around a bar (not shown) included in unit 208. The print media 112 then exits unit 208 front side up, as shown in region 210. After exiting unit 208, the print media 112 then wraps around stationary turnbar 202 and is directed along the output path 206. The print media 112 has now been inverted or turned over (see region 212) and the back side of print media 112*b* is positioned to receive ink from the linehead(s) in the next printing module (e.g., printing module 104 in FIG. 1). The print media 112 passes over bar 214 and exits the turnover module 116 along the output path 206.

FIG. 3 is another top perspective view of the turnover module 116 shown in FIG. 2. As discussed earlier, print media 112 wraps around stationary turnbar 200 and then wraps around bar 300 in unit 208. After exiting unit 208, the print media 112 wraps around stationary turnbar 202 and is directed along the output path 206. The print media 112 is inverted or turned over with the back side of print media 112*b* positioned to receive ink from the linehead(s) when the print media exits turnover module 116. FIG. 4 illustrates the path of the print media 112 through the turnover module 116 shown in FIGS. 2 and 3.

Figure 5:
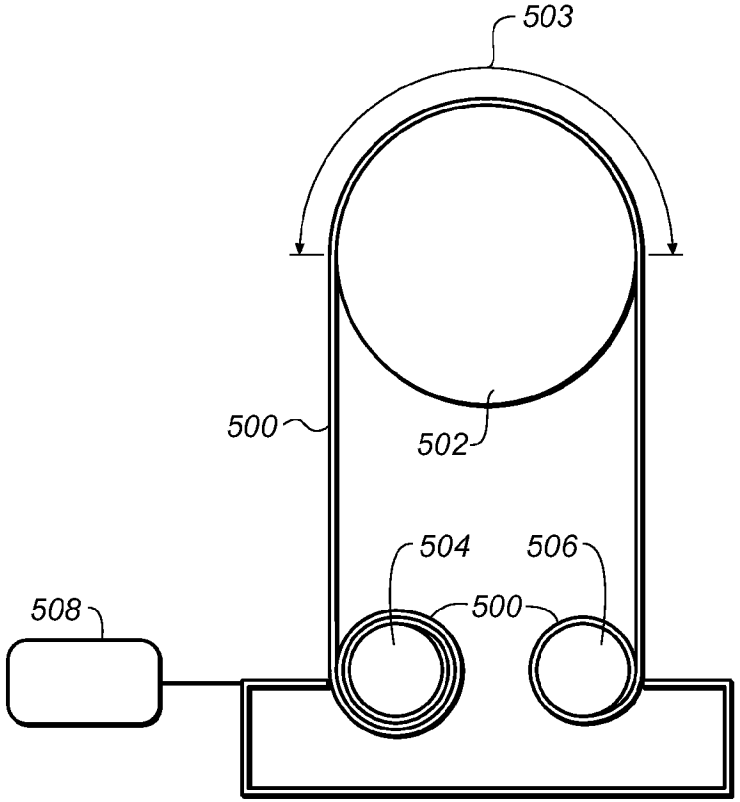
FIG. 5 depicts a side view of one example of a turnbar and replaceable cover material suitable for use in a turnover module in an embodiment in accordance with the invention.

Referring now to FIG. 5, there is shown a side view of one example of a turnbar and replaceable cover material suitable for use in a turnover module in an embodiment in accordance with the invention. A cover material 500 wraps around a turnbar 502. The cover material 500 is made of a material having a low coefficient of friction in one embodiment. When the portion 503 of the cover material 500 that is wrapped around the turnbar 500 needs replacement, a source roller 504 and a take-up roller 506 are rotated to replace the cover material 500 disposed over turnbar 502. The source roller 504 has unused cover material wrapped around it and the take-up roller 506 receives the used cover material.

The widths of the source roller 504 and the take-up roller 506 correspond to the width of the lumbar 502 in an embodiment in accordance with the invention. In other embodiments, cover material having different widths can be used with source and take-up rollers. An operator can change the source and take up rollers in between print jobs to customize the width of the cover material for a particular type of web.

The source roller 504 and the take-up roller 506 are rotated manually or connected to a motor 508 and rotated automatically to replace the cover material disposed over portion 503. In another embodiment, the motor can continuously rotate the source roller 504 and the take-up roller 506 during a print job or for a given amount of time.

Replacement of the cover material can occur on a regular schedule based on the characteristics of the type of print media running on the printing system, or replacement can occur when an operator determines replacement of the material is necessary.

The cover material 500 maintains a tension around the turnbar 502 to avoid slipping by placing the source and take-up rollers a given distance from the turnbar 502. A locking mechanism can be used to lock the source and take-up rollers or the cover material 500 in place and prevent slipping.

Figure 6:
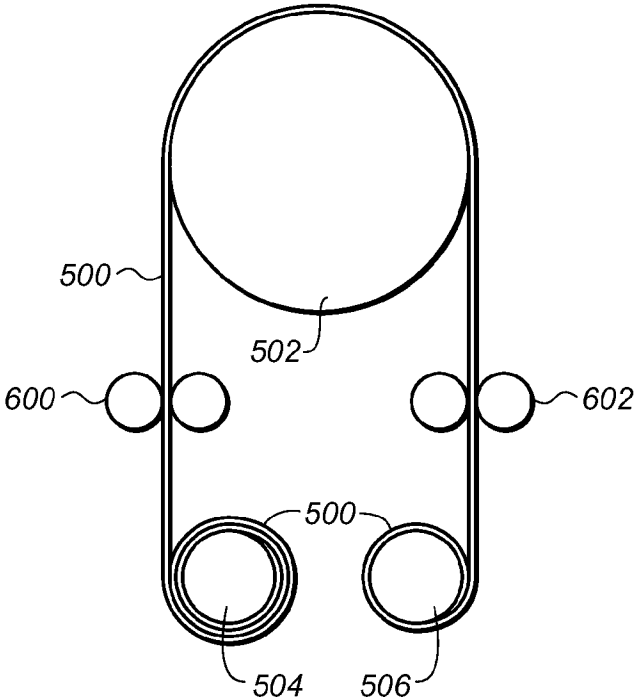
FIG. 6 illustrates a side view of another example of a turnbar and replaceable cover material suitable for use in a turnover module in an embodiment in accordance with the invention.

FIG. 6 depicts a side view of another example of a turnbar and replaceable cover material suitable for use in a turnover module in an embodiment in accordance with the invention. A pair of pinch rollers 600 is positioned between the source roller 504 and the turnbar 502. Another pair of pinch rollers 602 is positioned between the turnbar 502 and the take-up roller 504. The cover material 500 is disposed between the rollers in both pairs of pinch rollers 600, 602. The pinch rollers 600, 602 are used to maintain a certain tension in the cover material 500 to prevent slipping or breaking of the cover material 500. The cover material 500 wraps around a turnbar 502.

In another embodiment in accordance with the invention can use only one pair of pinch rollers. Alternatively, a locking mechanism can be used with the source roller, the take-up roller, or both the source roller and the take-up roller.

The invention has been described in detail with particular reference to certain preferred embodiments thereof, but it will be understood that variations and modifications can be effected within the spirit and scope of the invention. And even though specific embodiments of the invention have been described herein, it should be noted that the application is not limited to these embodiments. In particular, any features described with respect to one embodiment may also be used in other embodiments, where compatible. And the features of the different embodiments may be exchanged, where compatible.

1. A paper transport system for transporting a web through a printing system can include a stationary bar positioned such that the web slides over a portion of an exterior surface of the bar; a rotatable source roller supplying unused cover material; and a rotatable take-up roller receiving used cover material, where cover material extends between the source roller and the take-up roller and is disposed over the portion of the exterior surface of the bar that the web slides over.
2. The paper transport system as in clause 1, where the bar includes at least one of a turnbar in a turnover module.
3. The paper transport system as in clause 1 or clause 2, where the cover material is made of a material having a low coefficient of friction.
4. The paper transport system in any one of clauses 1-3 can include a locking mechanism for maintaining tension in the cover material.
5. The paper transport system as in clause 4, where the locking mechanism includes at least one pair of pinch rollers with the cover material disposed between each pinch roller in the pair of pinch rollers.
6. The paper transport system in any one of clauses 1-5 can include a motor connected to the rotatable source and take-up rollers.
7. A turnover module in a printing system can include at least one turnbar, and for each turnbar, a rotatable source roller supplying unused cover material and a rotatable take-up roller receiving used cover material, where cover material extends between the source roller and the take-up roller and is disposed over a portion of an exterior surface of the turnbar that a web slides over.
8. The turnover module as in clause 7, where the cover material is made of a material having a low coefficient of friction.
9. The turnover module in clause 7 or clause 8 can include a locking mechanism for maintaining a tension in the cover material.
10. The turnover module as in clause 9, where the locking mechanism includes at least one pair of pinch rollers with the cover material disposed between each pinch roller in the pair of pinch rollers.
11. The turnover module in any one of clauses 7-10 can include a motor connected to the rotatable source and take-up rollers.
12. A method for replacing a cover material disposed over a portion of an exterior surface of a bar in a printing system can include determining whether the cover material disposed over the portion of the exterior surface of a bar needs replacement; and if the cover material needs replacement, rotating a source roller supplying unused cover material and rotating a take-up roller receiving used cover material where cover material extends between the source roller and the take-up roller and is disposed over the portion of the exterior surface of the turnbar.
13. The method in clause 12 can include engaging a locking mechanism to maintain tension in the cover material.
14. A method for replacing a cover material disposed over a portion of an exterior surface of a bar in a printing system can include continuously rotating a source roller supplying unused cover material and continuously rotating a take-up roller receiving used cover material where cover material extends between the source roller and the take-up roller and is disposed over the portion of the exterior surface of the turnbar.
15. The method as in clause 14, where continuously rotating a source roller supplying unused cover material and continuously rotating a take-up roller receiving used cover material comprises continuously rotating during a print job a source roller supplying unused cover material and continuously rotating during the print job a take-up roller receiving used cover material.

| PARTS LIST | |
|---|---|
| 100 | printing system |
| 102 | printing module |
| 104 | printing module |
| 106 | linehead |
| 108 | dryer |
| 110 | quality control sensor |
| 112 | print media |
| 112f | front side of print media |
| 112b | back side of print media |
| 114 | feed direction |
| 116 | turnover module |
| 200 | turnbar |
| 202 | turnbar |
| 204 | input path |
| 206 | output path |
| 208 | unit |
| 210 | region |
| 212 | region |
| 214 | roller |
| 300 | roller |
| 500 | turnbar |
| 502 | replaceable cover material |
| 503 | portion of turnbar |
| 504 | supply roller |
| 506 | take up roller |
| 508 | motor |
| 600 | pair of pinch rollers |
| 602 | pair of pinch rollers |
| A, B, C, D, E, F, G, H, I, J, K, L, M, N, O, P | Rollers |
| SW | S-wrap |

The invention claimed is:

1. A paper transport system for transporting a web through a printing system, comprising:

a stationary turnbar positioned such that the web slides over a portion of an exterior surface of the bar;

a rotatable source roller supplying unused cover material; and a rotatable take-up roller receiving used cover material, wherein cover material extends between the source roller and the take-up roller and is disposed over the portion of the exterior surface of the bar that the web slides over.

2. The paper transport system as in claim 1, wherein the turnbar is in a turnover module.

3. The paper transport system as in claim 1, wherein the cover material is made of a material having a low coefficient of friction.

4. The paper transport system as in claim 1, further comprising a locking mechanism for maintaining tension in the cover material.

5. The paper transport system as in claim 4, wherein the locking mechanism comprises at least one pair of pinch rollers with the cover material disposed between each pinch roller in the pair of pinch rollers.

6. The paper transport system as in claim 1, further comprising a motor connected to the rotatable source and take-up rollers.

7. A turnover module in a printing system, comprising:

at least one turnbar; and for each turnbar, a rotatable source roller supplying unused cover material and a rotatable take-up roller receiving used cover material, wherein cover material extends between the source roller and the take-up roller and is disposed over a portion of an exterior surface of the turnbar that a web slides over.

8. The turnover module as in claim 7, wherein the cover material is made of a material having a low coefficient of friction.

9. The turnover module as in claim 8, further comprising a locking mechanism for maintaining a tension in the cover material.

10. The turnover module as in claim 9, wherein the locking mechanism comprises at least one pair of pinch rollers with the cover material disposed between each pinch roller in the pair of pinch rollers.

11. The turnover module as in claim 7, further comprising a motor connected to the rotatable source and take-up rollers.

12. A method for replacing a cover material disposed over a portion of an exterior surface of a turnbar in a turnover module in a printing system, comprising:

continuously rotating a source roller comprising unused cover material and continuously rotating a take-up roller comprising used cover material where cover material extends between the source roller and the take-up roller and is disposed over the portion of the exterior surface of the turnbar.

13. The method as in claim 12, wherein continuously rotating a source roller comprising unused cover material and continuously rotating a take-up roller comprising used cover material comprises continuously rotating during a print job a source roller comprising unused cover material and continuously rotating during the print job a take-up roller comprising used cover material.

* * * * *